United States Patent [19]

Stalder et al.

[11] Patent Number: 4,821,503

[45] Date of Patent: Apr. 18, 1989

[54] METHOD AND APPARATUS FOR MONITORING A PREDETERMINED YARN QUALITY AT A TEXTILE MACHINE, ESPECIALLY AT A FALSE-TWIST JET SPINNING APPARATUS

[75] Inventors: Herbert Stalder, Kollbrunn; Peter Egloff, Aadorf; Rolf Binder, Schottikon; Josef Baumgartner, Sirnach, all of Switzerland

[73] Assignee: Maschinenfabrik Rieter AG, Winterthur, Switzerland

[21] Appl. No.: 185,688

[22] Filed: Apr. 25, 1988

[30] Foreign Application Priority Data

Apr. 27, 1987 [CH] Switzerland ..... 01601/87

[51] Int. Cl.[4] ..... D01H 13/10; D02G 1/16

[52] U.S. Cl. ..... 57/264; 57/333

[58] Field of Search ..... 57/264, 333, 352

[56] References Cited

U.S. PATENT DOCUMENTS

| | | | |
|---|---|---|---|
| 3,742,692 | 7/1973 | Bense | 57/333 X |
| 3,848,404 | 11/1974 | London | 57/333 X |
| 4,058,962 | 11/1977 | Spescha et al. | 57/265 |
| 4,083,172 | 4/1978 | Norris et al. | 57/333 X |
| 4,183,202 | 1/1980 | Morihashi | 57/333 X |
| 4,565,063 | 1/1986 | Stalder et al. | 57/333 X |
| 4,566,262 | 1/1986 | Schmucker | 57/264 |

FOREIGN PATENT DOCUMENTS

| | | |
|---|---|---|
| 0148402 | 7/1985 | European Pat. Off. . |
| 0181105 | 5/1986 | European Pat. Off. . |
| 2525560 | 12/1976 | Fed. Rep. of Germany . |
| 3316657 | 11/1984 | Fed. Rep. of Germany . |
| 3424709 | 2/1986 | Fed. Rep. of Germany . |

*Primary Examiner*—Donald Watkins

*Attorney, Agent, or Firm*—Werner W. Kleeman

[57] ABSTRACT

To control the yarn quality of a yarn produced by a textile machine, particularly a false-twist jet spinning apparatus, there is provided at the end of the spinning operation, however, upstream of the pair of withdrawal rolls for the outfeed of the produced yarn, a yarn tension measuring device. Upon falling outside of a predeterminate yarn tension tolerance or tension range the yarn tension measuring device controls operation of the false-twist jet spinning apparatus such that, as required, there is accomplished an appropriate increase or decrease of the yarn tension of the yarn produced by the false-twist jet spinning apparatus. Alteration of the yarn tension can be achieved, for instance, by varying the blowing intensity or energy of the air utilized for the spinning operation as well as by varying the angle at which there is blown in the air used for the spinning operation or by varying the rotational speed of the delivery rolls which deliver the formed yarn or by selected combinations of these measures.

25 Claims, 1 Drawing Sheet

Fig. 1
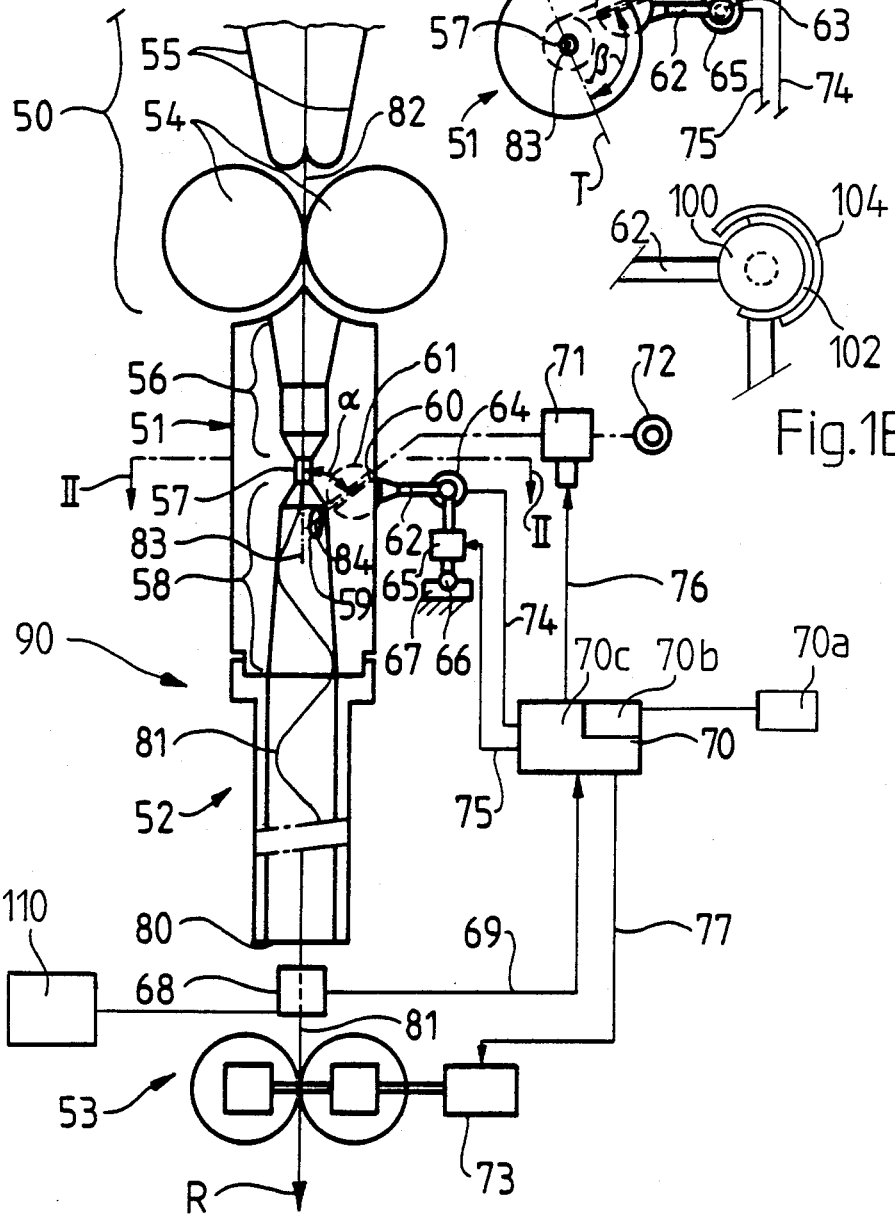
Fig. 1A
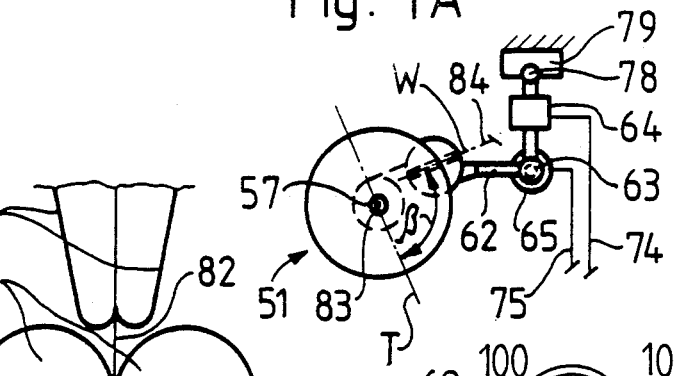
Fig.1B

METHOD AND APPARATUS FOR MONITORING A PREDETERMINED YARN QUALITY AT A TEXTILE MACHINE, ESPECIALLY AT A FALSE-TWIST JET SPINNING APPARATUS

CROSS-REFERENCE TO RELATED APPLICATION

This application is relate to our commonly assigned, co-pending U.S. application Ser. No. 07/185,687, filed Apr. 25, 1988, and entitled "METHOD AND APPARATUS FOR MONITORING A PREDETERMINED YARN QUALITY AT A TEXTILE MACHINE, ESPECIALLY AT A FRICTION SPINNING APPARATUS".

BACKGROUND OF THE INVENTION

The present invention relates to a new and improved method for monitoring a predetrminate or predetrmined yarn quality of a yarn produced by a textile machine, especially a false-twist jet spinning apparatus, and to a new and improved false-twist jet spinning apparatus or performing the inventive method.

In the context of this disclosure, the term "yarn" or equivalent expression, ar used in their broader sense to encompass not only yarns as such, but also threads and other filamentary material.

In the production of yarn, the evenness of the yarn quality at each spinning position or location, as well as the yarn quality of each spinning position or location in comparison to that at the other individual spinning positions or locations, plays an important role.

German Published Patent Application No. 3,517,763 A1, published Nov. 20, 1986, discloses a method and an apparatus for maintaining a predetermined yarn twist to enable checking or controlling the evenness of this yarn quality parameter.

Direct measurement of yarn twist while the spinning process is in progress cannot be achieved. Accordingly, the yarn twist must be estimated with the aid of a yarn diameter measurement. This can be accomplished without contact between the yarn to be measured and the measuring device, i.e. can be measured only indirectly.

SUMMARY OF THE INVENTION

Therefore with the foregoing in mind it is a primary object of the present invention to provide a new and improved method and apparatus for reliably monitoring a predetermined yarn quality in a manner which is not afflicted with the aforementioned shortcomings of the prior art constructions.

Another and more specific object of the present invention aims at providing a new and improved method and apparatus for monitoring a predeterminate yarn quality, particularly by measuring the yarn tension at a textile machine, and specifically at a false-twist jet spinning apparatus, in a highly reliable and accurate fashion and, when necessary, undertaking appropriate corrective measures to ensure for uniformity of the produced yarn or the like.

Still a further significant object of the present invention, aims at performing a direct measurement at the fabricated yarn in order to obtain a highly reliable estimate of the yarn quality.

Now in order to implement these and still further objects of the present invention, which will become more readily apparent as the description proceeds, the method for monitoring a predeterminate yarn quality of a yarn spun by a false-twist jet spinning apparatus is manifested, among other things, by the features that there is measured the mechanical tension of the running yarn. This measured value is compared with a predeterminate value or tolerance range for the tension. In the event of a deviation, such as falling below or undershooting or exceeding or overshooting the predeterminate tension tolerance range or value, the false-twist jet spinning apparatus is controlled or affected in a manner for correspondingly varying or altering the yarn tension, in other words, appropriately increasing or decreasing the same as needed.

As alluded to above, the invention is not only concerned with the aforementioned method aspects, but also relates to a new and improved construction of a false-twist jet spinning apparatus for the performance of the inventive method. The false-twist jet spinning apparatus comprises means or structure defining a spinning location or position. Following or downstream of the spinning location or position, there is provided a yarn tension measuring device for generating a measured or measurement signal representative of the momentarily measured yarn tension of the running yarn. Additionally, there are provided means which alter or adjust the yarn tension. Such yarn tension altering means can, for instance, alter the inflow direction or change the energy of the pressure or pressurized air used for the spinning of the yarn in the false-twist jet spinning apparatus. As a further possibility the yarn tension altering means can change the yarn tension by changing the rotational speed of the withdrawal rolls for withdrawing the spun yarn. Desired combinations of such measures or techniques are equally possible.

Also, display or indicator means for displaying the yarn tension can be provided on the basis of yarn tension can be changed by manually implementing or initiating the above-described measures or techniques, or it is also possible to provide control means to automatically operate the means for changing or altering the yarn tension on the basis of the measured or measurement signal.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 illustrates part schematically a longitudinal sectional view through a friction spinning apparatus in the form of a false-twist jet spinning apparatus constructed according to the present invention;

FIG. 1A illustrates a section, conveniently depicted without any cross-hatching for drawing illustration simplification, through the false-twist jet spinning apparatus of FIG. 1, taken substantially along the line II—II thereof; and FIG. 1B illustrates a detail of the arrangement of FIGS. 1 and 1A.

DETAILED DESCRIPTION OF THE PREFERRED EMBODIMENTS

Describing now the drawings, it is to be understood that to simplify the showing thereof, only enough of the false-twist jet spinning apparatus, and the related apparatus or structure for monitoring a predeterminate yarn quality have been illustrated therein as are needed to enable one skilled in the art to readily understand the underlying principles and concepts of this invention. Turning now specifically to FIG. 1 of the drawings, the therein depicted exemplary embodiment of false-twist jet spinning apparatus 90 comprises a drafting arrangement 50, a false-twist spinning jet 51 defining a spinning position or location, a yarn guide tube or conduit 52 connected thereto and a withdrawal or delivery roller pair 53.

Only the withdrawal roller pair 54 and the fiber guiding aprons 55 of the drafting arrangement 50 have been conveniently illustrated in as much as such construction is well known.

The false-twist spinning jet 51 comprises an infeed portion 56, a guide orifice or port 57 and a twist generating portion 58.

A pressure or pressurized air infeed duct 59 opens into the infeed region of the twist generating portion 58 following the guide orifice 57 as viewed in the predeterminate direction of yarn movement indicated by the arrow R. The pressure or pressurized air is fed in or delivered by a pressure air infeed duct 59 by means of an infeed nozzle 60 which is adjustable in the airflow direction. The relation of the diameter to the length of the pressure air infeed duct 59 must be so selected that the airflow blown in by the infeed nozzle 60 is disturbed neither by the walls nor by the opening of the pressure air infeed duct 59.

The infeed nozzle 60 is provided in a spherical or semi-spherical jet body 61 (only the first possibility being shown). This jet body 61 is rotatably supported in the manner of a ball joint in the false-twist spinning jet 51.

In order to adjust the jet body 61, the latter is provided with an adjusting lever or lever member 62 which is connected via a triple ball joint 63 (FIGS. 1A and 1B) with a horizontally disposed adjusting motor 64 (FIG. 1A) and a vertically disposed adjusting motor 65 (FIG. 1). The terms "horizontally disposed" and "vertically disposed" are to be conveniently interpreted only with reference to the view represented in FIG. 1 and otherwise are not to be construed in any limiting sense. The term "triple ball joint" relates to a ball 100 with a hollow partial ball or pan 102 mounted thereon serving as a socket and a second hollow ball or pan 104, likewise serving as a socket, mounted over the first hollow partial ball or pan 102, as such arrangement is depicted in FIG. 1B. The sockets defined by the pans 102 and 104, can be provided with resilient or elastic regions through the provision of suitable slits or cuts in such pans 102 and 104. In the arrangement depicted, the adjusting or adjustment lever 62 is connected, for example, with the ball or ball member 100 and the adjusting motors 64 and 65 are connected, for instance, with the respective sockets defined by the pans 104 and 102.

Each adjusting or adjustment motor 65 and 64, is supported individually at its end remote from the triple ball joint 63, by means of a single ball joint 66 and 67, respectively, in a fixedly mounted housing portion or part 67 and 79, respectively.

A yarn tension measuring device 68 is provided after or downstream of the yarn guide tube or conduit 52 and before the withdrawal roller or roll pair 53. Such yarn or thread tension measuring devices 68 are known in the art, and one such suitable construction is commercially available, for example under the trade designation Electronic-Tensiometer R-1192 from the Swiss firm Rothschild Company of Traubenstrasse 3, CH-8002, Zürich, Switzerland. This yarn tension measuring device 68 delivers measurement signals in the form of output signals and representative of the momentarily measured yarn tension and appearing on the line or conductor 69 to a suitable control unit or device 70.

This control unit or device 70 is of conventional design and does not constitute subject matter of the present invention. Basically, the control unit 70 has a reference or set input **70*a* at which there is set a desired reference or set value of the yarn tension or tolerance value or range with which there is then compared the yarn tension measured by the yarn tension measuring device 68 and on the basis of such comparison in the comparator, generally indicated by reference character 70*b*, there is delivered at the output side or section 70*c* of the control unit or device 70**, a suitable output signal which perfects a suitable control operation for either increasing or decreasing the yarn tension as the need dictates and as will be described more fully hereinafter. Control units or devices suitable for such purposes are well known in the electrical and electronic art as well as in the textile art. An example of a suitable control device which can be utilized in the arrangement of the present invention has been disclosed, by way of example and not limitation, in U.S. Pat. No. 4,275,483, granted June 30, 1981, to which reference may be readily had and the disclosure of which is incorporated herein by reference.

Further, the infeed nozzle 60 is connected with an adjustable pressure regulating valve or valve unit 71 which is supplied with pressure or compressed air by a suitable pressure or pressurized air source 72.

The withdrawal or delivery roller pair 53 is driven by a drive motor 73.

The control unit or device 70 processes the measurement signals appearing on the line or conductor 69 to form an output signal appearing, for instance, on the line or conductor 74 in order to control the adjusting or adjustment motor 64, an output signal appearing on the line or conductor 75 in order to control the adjusting or adjustment motor 65, an output signal appearing on the line or conductor 76 in order to control the pressure regulating valve 71 and an output signal appearing on the line or conductor 77 in order to control the speed of rotation of the drive motor 73. As desired various combinations of individual ones of these output signals could be generated if desired.

An airflow infeed angle $\alpha$ (FIG. 1) and an airflow infeed angle $\beta$ (FIG. 1A) are adjusted with the aid of the adjusting motors 64 and 65.

The airflow infeed angle $\alpha$ is contained in an imaginary plane W which contains the axis of symmetry 84 (FIGS. 1 and 1A) of the inflow nozzle 60 and which is either parallel to the axis of symmetry 83 (FIGS. 1 and 1A) of the guide orifice 57 or contains that axis of symmetry 83.

The angle $\alpha$ is formed in this plane between the axis of symmetry 84 and a straight line (not shown) which is either substantially parallel to the axis of symmetry 84 if the plane W is substantially parallel to the axis of symmetry 83, or is substantially coaxial with the axis of symmetry 83 if the plane W contains the axis of symmetry 83. The air inflow angle $\beta$ is defined between the plane W and a further imaginary plane T which contains the axis of symmetry 83. The angle $\beta$ is essentially a right angle (90°-angle) if the plane W also contains the axis of symmetry 83. The smallest angle $\beta$ is defined if the plane W is essentially parallel to the axis of symmetry 83 such that the airflow from the infeed nozzle 60 enters the twist-generating jet 58 substantially tangentially.

Inflow of pressure or compressed air into the twist-generating portion or part 58 with air inflow angles $\alpha$ and $\beta$ selected lower than 90° causes, in addition to a crank-like twisting effect on the yarn, as will be described later, a suction effect for the infeed portion or part 56 so that air is drawn into this infeed portion or part 56 from the delivery rolls 54.

This air blown in via the infeed nozzle 60 together with the air drawn in via the infeed portion 56 flows through the twist-generating portion or part 58 and leaves the yarn guide tube or conduit 52 at its exit opening 80.

In operation, a fiber sliver is fed into the drafting arrangement 50 and is drawn or drafted therein to a desired degree. At the exit from or outlet side of the drafting arrangement 50, the delivery rolls 54 thereof pass the sliver 82, spread to a desired extent, into the infeed portion 56 which guides this fiber sliver 82 with the aid of the air drawn in by suction towards the guide orifice 57. A yarn core is formed in known manner by means of this guide orifice 57 and is grasped by the airflow of the infeed nozzle 60 upon entering the twist-generating portion or part 58 and is rotated in a crank-like fashion. Twist is generated in the yarn core by this crank-like motion and travels opposite the direction of thread movement indicated by the arrow R back towards the clamping line or nip of the delivery roller pair 54.

This procedure, including the wrapping of the twisted yarn core with edge fibers, is known state-of-the-art and published for example, in European Published Patent Application No. 131,170, published Jan. 16, 1985, and to which reference may be readily had and the disclosure of which is incorporated herein by reference. Further examples are set out in the article written by Professor Hans W. Krause and published in "Melliand Textilberichte 1/1987".

Assuming a constant infeed speed to the delivery roller pair 54, the yarn tension in the region of the yarn tension measuring device 68 is variable either by adjustment of the angles $\alpha$ and $\beta$ and/or of the air throughflow (m3/min) through the infeed nozzle 60 and/or the speed of the withdrawal roller pair or withdrawal rollers 53.

By the adjustment of the angles $\alpha$ and $\beta$ and the intensity or energy of the air infeed into the infeed nozzle 60, the crank effect can be changed as can the transporting or forwarding effect on the yarn 81 in the yarn movement direction represented by the arrow R. By adjusting the speed of rotation of the withdrawal rollers or rolls 53, the so-called spinning draft can be adjusted, the term "spinning draft" referring to the relationship between the speed of the running yarn 81 at the withdrawal rollers 53 and the speed of the fiber sliver 82 at the delivery roller pair 54.

If now, for example, in operation a signal is issued or delivered by the yarn tension measuring device 68, and is determined to be too high, in other words, above the yarn tension tolerance, by the control unit or device 70, then the intensity of air infeed into the infeed nozzle 60, with constant angles $\alpha$ and $\beta$ and constant spinning draft, can be reduced within a tolerance or tolerance range defined therefor. Alternatively, the angle $\alpha$, with constant inflow intensity and constant angle $\beta$ and constant spinning draft, can be reduced within a tolerance range defined therefor. As a further alternative, the angle $\beta$ can be reduced within a tolerance or tolerance range defined therefor with constant infeed intensity and constant angle $\alpha$ and spinning draft. As a still further alternative, the speed of rotation of the withdrawal rollers or rolls 53 can be reduced, also within a tolerance or tolerance range defined therefor, with constant infeed intensity, constant angles $\alpha$ and $\beta$ and constant speed of the fiber sliver 82 at the delivery roller pair 54. Furthermore, the spinning speed can be adjusted with constant measures as previously discussed and given yarn count until settling within the given yarn tension tolerance or tolerance range.

On the other hand, if the yarn tension is too low, the opposite steps are carried out.

It will be clear that a combination of the aforedescribed steps can be performed if an individual step alone does not give the desired effect or result.

It is also noted that the yarn tension measured by the yarn tension measuring device 68 can be appropriately displayed or indicated by the display or indicator device 110 (FIG. 1) and on the basis of which the yarn tension can be then altered or controlled by manually initiating or accomplishing the aforedescribed yarn tension correction measures.

A simplified variant of the embodiment shown in FIGS. 1 and 1A comprises a jet body 61 movable solely in the direction of movement of the angle $\alpha$. In this case, the adjusting or adjustment motor 64 is eliminated with all related structure required for its functioning. Also, the adjusting or adjustment motor 65 no longer can be supported on the ball joint 66 but must be pivotably supported such that the infeed nozzle 60 is movable only in the region of the angle $\alpha$.

The control unit 70 shown for the false-twist jet spinning apparatus 90 of FIGS. 1 to 1C is designed as an individual unit for each so-called spinning position or location (a plurality of spinning positions or locations constitute a spinning machine). It will be clear, however, that a solution of this type is expensive and is not absolutely necessary in view of the tension variations which occur slowly as a rule.

It is therefore known from the rotor open-end spinning technique that so-called travelling devices or robots carry out checking and operating functions on respective spinning units, so that an optimalization can be achieved as regards costs and frequency of the operations to be performed per spinning position or location.

It is therefore clear and should be so understood that a range of modifications can be provided in connection with travelling devices or robots, for example, all adjusting or positioning motors or the like required for adjusting the elements can be provided per spinning position, and only the yarn tension measuring equipment and control is allocated to the travelling device or robot; this represents the simplest solution mechanically.

As another variant, a travelling device or robot can measure the yarn tension and indicate it by display means, such as the previously described display or indicator device 110, and the elements to be adjusted in order to change the tension are operated manually until the tension again lies in the given tolerance range.

A further application of the yarn tension measurement lies in the simple monitoring of the spinning position or location by means of the yarn tension measuring step or operation, i.e. that none of the aforedescribed measures to adjust the yarn tension are carried out, and on the basis of the given yarn tension tolerances a decision is made to stop the spinning unit in order to deal with the corresponding defect.

It will therefore be clear that the inventive concept of using the yarn tension to maintain the spinning apparatus on a yarn quality level corresponding to the desired yarn quality, is not limited to the illustrated and described examples.

While there are shown and described present preferred embodiments of the invention, it is to be distinctly understood that the invention is not limited thereto, but may be otherwise variously embodied and practiced within the scope of the following claims. Accordingly,

What is claim is:

1. A method for monitoring a predeterminate yarn quality of a yarn spun by a false-twist jet spinning apparatus, comprising the steps of:

forming a spun yarn at the false-twist jet spinning apparatus;

delivering the spun yarn as a running yarn from the false-twist jet spinning apparatus;

measuring the mechanical tension of the running yarn to obtain a measured value of such measured mechanical tension in order to determine the quality of the spun yarn; and upon a predeterminate deviation of the determined quality of the spun yarn controlling operation of the false-twist jet spinning apparatus so as to establish a predeterminate desired tension of the running yarn.

2. A method for monitoring a predeterminate yarn quality of a yarn spun by a false-twist jet spinning apparatus, comprising the steps of:

delivering fiber material to a false-twist jet spinning apparatus;

forming from the fiber material at the false-twist jet spinning apparatus a spun yarn;

delivering the spun yarn as a running yarn from the -. false-twist jet spinning apparatus;

measuring the mechanical tension of the running yarn to obtain a measured value of such measured mechanical tension in order to determine the quality of the running yarn;

comparing the measured value with a predeterminate reference value defining a predeterminate tension tolerance for the yarn tension;

determining by said comparison any deviation of the measured value from the predeterminate tension tolerance; and upon detection of a deviation of the measured value from the predeterminate tension tolerance controlling operation of the false-twist jet spinning apparatus to affect the tension of the running yarn so as to control the quality of the spun yarn.

3. The method as defined in claim 2, further including the step of:

continuously monitoring the yarn tension of the running yarn.

4. The method as defined in claim 3, further including the step of:

immediately after falling below the predeterminate tension tolerance acting upon the false-twist jet spinning apparatus such as to increase the tension of the running yarn.

5. The method as defined in claim 4, further including the step of:

after falling below the predeterminate tension tolerance stopping the operation of the false-twist jet spinning apparatus until such time as the false-twist jet spinning apparatus can be acted upon such as to increase the tension of the running yarn.

6. The method as defined in claim 4, further including the step of:

if after acting upon the false-twist jet spinning apparatus such action is unsuccessful then stopping the false-twist jet spinning apparatus in order to correct defect in operation of the false-twist jet spinning apparatus.

7. The method as defined in claim 3, further including the step of:

immediately after exceeding the predeterminate tension tolerance acting upon the false-twist jet spinning apparatus such as to decrease the tension of the running yarn.

8. The method as defined in claim 7, further including the step of:

after exceeding the predeterminate tension tolerance stopping the operation of the false-twist jet spinning apparatus until such time as the false-twist jet spinning apparatus can be acted upon such as to decrease the tension of the running yarn.

9. The method as defined in claim 7, further including the step of:

if after acting upon the false-twist jet spinning apparatus such action is unsuccessful then stopping the false-twist jet spinning apparatus in order to correct defect in operation of the false-twist jet spinning apparatus.

10. The method as defined in claim 2, further including the step of:

intermittently monitoring the yarn tension of the running yarn.

11. The method as defined in claim 10, further including the step of:

immediately after falling below the predeterminate tension tolerance acting upon the false-twist jet spinning apparatus such as to increase the tension of the running yarn.

12. The method as defined in claim 11, further including the step of:

after falling below the predeterminate tension tolerance stopping the operation of the false-twist jet spinning apparatus until such time as the false-twist jet spinning apparatus can be acted upon such as to increase the tension of the running yarn.

13. The method as defined in claim 11, further including the step of:

if after acting upon the false-twist jet spinning apparatus the action is unsuccessful then stopping the false-twist jet spinning apparatus in order to correct defect in operation of the false-twist jet spinning apparatus.

14. The method as defined in claim 10, further including the step of:

immediately after exceeding the predeterminate tension tolerance acting upon the false-twist jet spinning apparatus such as to decrease the tension of the running yarn.

15. The method as defined in claim 14, further including the step of:

after exceeding the predeterminate tension tolerance stopping the operation of the false-twist jet spinning apparatus until such time as the false-twist jet spinning apparatus can be acted upon such as to decrease the tension of the running yarn.

16. The method as defined in claim 14, further including the step of:

if after acting upon the false-twist jet spinning apparatus such action is unsuccessful then stopping the false-twist jet spinning apparatus in order to correct defect in operation of the false-twist jet spinning apparatus.

17. A false-twist jet spinning apparatus for producing a yarn and monitoring a predeterminate yarn quality of a yarn spun by the false-twist jet spinning apparatus, comprising:

means defining a spinning position for the false-twist jet spinning apparatus for producing a spun yarn defining a running yarn travelling in a predetermined direction;

a yarn tension measuring device arranged downstream of the spinning position with respect to the predetermined direction of travel of the spun yarn;

said yarn tension measuring device delivering a measurement signal indicative of the measured yarn tension of the spun yarn; and means for adjusting tension of the spun yarn in response to the measurement signal delivered by the yarn tension measuring device.

18. The false-twist jet spinning apparatus as defined in claim 17, further including:

display means for displaying the yarn tension as represented by the measurement signal.

19. The false-twist jet spinning apparatus as defined in claim 18, wherein:

the means for adjusting the yarn tension is manually operable on the basis of the yarn tension displayed at said display means.

20. The false-twist jet spinning apparatus as defined in claim 17, further including:

control means for operating the means for adjusting the yarn tension automatically on the basis of said measurement signal.

21. The false-twist jet spinning apparatus as defined in claim 17, wherein:

said means defining said spinning position comprises a twist jet supplied with pressure air;

means for supplying pressure air to the twist jet; and said means for adjusting the yarn tension serves to change the energy of the supplied pressure air.

22. The false-twist jet spinning apparatus as defined in claim 17, further including:

said means defining said spinning position comprises a twist jet supplied with pressure air;

means for supplying pressure air to the twist jet; and said means for adjusting the yarn tension comprises means for changing the inflow direction of the infed pressure air.

23. The false-twist jet spinning apparatus as defined in claim 17, further including:

withdrawal roll means located downstream of the spinning position for withdrawing the spun yarn; and said means for adjusting the yarn tension comprises means for changing the rotational speed of said withdrawal roll means.

24. The false-twist jet spinning apparatus as defined in claim 17, further including:

a yarn tension measuring device provided for each spinning position.

25. The false-twist jet spinning apparatus as defined in claim 24, wherein:

said yarn tension measuring device constitutes a mobile structure movable between predeterminate spinning positions.

* * * * *

UNITED STATES PATENT AND TRADEMARK OFFICE

CERTIFICATE OF CORRECTION

PATENT NO. : 4,821,503

DATED : April 18, 1989

INVENTOR(S) : HERBERT STALDER et al

It is certified that error appears in the above-identified patent and that said Letters Patent is hereby corrected as shown below:

Column 1, line 9, after "is" please delete "relate" and insert --related--

Column 1, line 19, after "a" please delete "predetrminate or predetr-" and insert --predeterminate or predeter---

Column 1, line 23, at the beginning of the line, please delete "or" and insert --for--

Column 1, line 25, please delete "expression, ar" and insert --expressions are--

Column 2, line 36, after "of" please insert --which the--

Signed and Sealed this

Twenty-sixth Day of September, 1989

*Attest:*

DONALD J. QUIGG

*Attesting Officer*

*Commissioner of Patents and Trademarks*